US009347252B2

(12) United States Patent
Klein

(10) Patent No.: US 9,347,252 B2
(45) Date of Patent: May 24, 2016

(54) FOOT-OPERATED DOOR OPENER, DOOR AND USE

(71) Applicant: Metiba Verwaltungs GmbH, Garbsen (DE)

(72) Inventor: Sascha Klein, Garbsen (DE)

(73) Assignee: Metiba Verwaltungs GmbH, Garbsen (DE)

( * ) Notice: Subject to any disclaimer, the term of this patent is extended or adjusted under 35 U.S.C. 154(b) by 0 days.

(21) Appl. No.: 14/448,864

(22) Filed: Jul. 31, 2014

(65) Prior Publication Data

US 2015/0020454 A1 Jan. 22, 2015

Related U.S. Application Data

(63) Continuation of application No. PCT/EP2013/000317, filed on Feb. 1, 2013.

(30) Foreign Application Priority Data

Feb. 1, 2012 (DE) ..... 10 2012 001 845

(51) Int. Cl.
*E05F 13/04* (2006.01)
*E05F 13/00* (2006.01)
(Continued)

(52) U.S. Cl.
CPC ..... *E05F 13/00* (2013.01); *E05B 53/001* (2013.01); *E05C 17/56* (2013.01); *E05F 5/027* (2013.01); *E05F 11/54* (2013.01); *E05B 17/0041* (2013.01); *E05B 47/0038* (2013.01); *E05B 63/20* (2013.01)

(58) Field of Classification Search
CPC ..... E05F 13/00; E05F 11/54; E05C 17/56; E05B 53/001
USPC ..... 49/263, 264, 272, 273, 274
See application file for complete search history.

(56) References Cited

U.S. PATENT DOCUMENTS 276,626 A 5/1883 Powell
283,770 A 8/1883 Geiger ..... 292/255
(Continued)

FOREIGN PATENT DOCUMENTS

DE 815 153 9/1951
DE 10113865 A1 10/2002
(Continued)

OTHER PUBLICATIONS

International Search Report (ISR) in parent application No. PCT/EP2013/000317, filed Feb. 1, 2013, ISR dated May 28, 2013 (3 pgs.).
(Continued)

*Primary Examiner* — Jerry Redman
(74) *Attorney, Agent, or Firm* — Shlesinger, Arkwright & Garvey LLP

(57) ABSTRACT

A foot-operated door opener, with a foot-operated actuator element is located in the lower region of a door for opening the door, and the foot-operated actuator element has a one foot tread element which, when actuated by a foot, at least partially pivots downwards and inwards. The foot tread element is also guided in a forcibly guided manner by way of a forcibly guided element and one forcibly-guided moving element. The foot tread element is connected rotatably to an articulated element and rotatably connected to the forcibly-guided moving element in such a manner that, upon actuation by a foot, the foot tread element both executes a movement downwards and is also moved as a whole at least partially outwards.

18 Claims, 4 Drawing Sheets

(51) Int. Cl.

| | |
|---|---|
| ***E05B 53/00*** | (2006.01) |
| ***E05C 17/56*** | (2006.01) |
| ***E05F 5/02*** | (2006.01) |
| ***E05F 11/54*** | (2006.01) |
| *E05B 47/00* | (2006.01) |
| *E05B 63/20* | (2006.01) |
| *E05B 17/00* | (2006.01) |

(56) References Cited

U.S. PATENT DOCUMENTS

| | | | | |
|---|---|---|---|---|
| 533,571 | A | 2/1895 | Tower | 49/263 |
| 584,588 | A | 6/1897 | Headland | 292/255 |
| 854,262 | A | 5/1907 | Young | 49/272 |
| 1,076,506 | A | 10/1913 | Marshall | 292/255 |
| 1,235,946 | A | 8/1917 | Vicenzi | 292/255 |
| 1,244,910 | A * | 10/1917 | Smith | 292/341.15 |
| 1,603,722 | A | 10/1926 | Stanley | 292/255 |
| 1,611,386 | A * | 12/1926 | Stanley | 49/263 |
| 1,882,536 | A | 10/1932 | Weinheimer | 292/255 |
| 2,021,914 | A | 11/1935 | Goulooze | 292/255 |
| 2,106,642 | A | 1/1938 | Matthews | 126/67 |
| 2,120,534 | A | 6/1938 | Wild | 292/255 |
| 2,741,504 | A | 4/1956 | Dale | 292/255 |
| 3,012,837 | A | 12/1961 | Morrissey, Jr. | 49/276 |
| 4,023,875 | A | 5/1977 | Difley et al. | 312/319.1 |
| 4,421,350 | A | 12/1983 | Gotomyo | |
| 4,569,546 | A | 2/1986 | Howard et al. | |
| 4,621,848 | A | 11/1986 | Pierce | |
| 5,193,863 | A | 3/1993 | McBain | |
| 5,434,457 | A * | 7/1995 | Josephs et al. | 307/326 |
| 5,622,416 | A * | 4/1997 | Rainey et al. | 312/319.9 |
| 6,360,488 | B1 * | 3/2002 | Darling | 49/274 |
| 8,745,922 | B1 * | 6/2014 | Matsuda et al. | 49/55 |
| 2013/0118085 | A1 * | 5/2013 | Hedemark | 49/356 |
| 2013/0207406 | A1 | 8/2013 | Klein | |
| 2014/0353985 | A1 | 12/2014 | Klein | |

FOREIGN PATENT DOCUMENTS

| | | | |
|---|---|---|---|
| DE | 102010035554 | A1 | 3/2012 |
| EP | 1048811 | A1 | 11/2000 |
| EP | 1 378 622 | A1 | 1/2004 |
| FR | 2951487 | A1 | 4/2011 |
| JP | 2079779 | | 6/1990 |
| JP | 2003038269 | A | 2/2003 |
| WO | WO0231297 | A1 | 4/2002 |
| WO | WO2012025230 | A1 | 3/2012 |

OTHER PUBLICATIONS

Canadian Office Action of Feb. 10, 2014, re Canadian Application No. 2,809,340, to Metiba Verwaltungs GmbH. (2 pages).

Japanese Office Action of Apr. 28, 2014 in JP Application No. 2013-525184 (4 pages).

PCT Schriflicher Bescheid (PCT Written Opinion) dated Dec. 27, 2011 (6 pgs.).

PCT Mitteilung Uber Die Ubermittlung Des Internationalen Recherchenberichts (Notification of the Transmittal of the International Search Report and the International Search Report) dated Dec. 27, 2011 (4 pgs.).

German Office Action dated Jun. 6, 2011 in DE 10 2010 035 554.2, filed Aug. 26, 2010 (4 pgs.).

English Translation of International Preliminary Report on Patentability of Feb. 26, 2013 in PCT International Application No. PCT/EP2011/004255, filed Aug. 25, 2011 (6 pgs.).

* cited by examiner

FOOT-OPERATED DOOR OPENER, DOOR AND USE

CROSS-REFERENCE TO RELATED APPLICATIONS

This application is a continuation of Application No. PCT/EP2013/000317, filed Feb. 1, 2013, which Application claims priority of German Application No. 10 2012 001 845.2, filed Feb. 1, 2012, and each of which is incorporated herein by reference.

FIELD OF THE INVENTION

The invention relates to a foot-operated door opener, a door, and use.

BACKGROUND OF THE INVENTION

Foot-operated door openers are known.

DE 101 13 865 A1 discloses a device for opening a door, in particular in wet rooms, whereby an actuating element used for actuation by the foot is provided in the door, and the actuating element is designed as a rod which protrudes from the door.

EP 1 048 811 A1 discloses in particular a door opening system which is equipped with a foot switch that is situated next to the door, whereby an actuator rod directly engages with a door opening mechanism.

WO 02/31297 A1 discloses a door opening mechanism which converts a translational movement, due to a step by the foot, into a rotational movement of a member which directly engages with a door opening mechanism.

U.S. Pat. No. 5,193,863 and U.S. Pat. No. 4,569,546 disclose a foot-operated door opener which is situated on the door in a flap-like manner, so that actuation by placing a foot on a plate-shaped or rotatable foot tread element causes an actuator rod to undergo a translational movement, so that the door may be opened by engagement with an opening mechanism of the door.

U.S. Pat. No. 4,621,848 discloses a foot-operated door opener in which a user may actuate a pedal-shaped foot-operated element which protrudes from the door, and a translational movement from top to bottom results in engagement with an opening mechanism of the door via an actuator rod, by means of which the door may be opened.

DE 10 2010 035 554 A1 discloses a foot-operated door opener having a foot-operated actuator element for opening the door situated on the lower region of the door, the foot-operated actuator element having an upper and a lower foot tread element which are connected to one another in an articulated manner, and which in each case at least partially pivot into the interior of the door upon actuation by the foot.

These foot-operated door opening devices known from the prior art, with the exception of the latter-mentioned one, share the common feature that on the one hand they allow a relatively rough, imprecise opening of the door by means of a foot, and on the other hand are associated with a certain potential for injury during operation due to somewhat cumbersome geometries. Although these problems are solved for the most part in the latter-mentioned device, in practice it has been found that the possibility for even more precise opening of the door is desirable.

OBJECTS AND SUMMARY OF THE INVENTION

An object of the invention, therefore, is to at least partially avoid the mentioned disadvantages.

This object on which the invention is based is achieved by a foot-operated door opener according to the invention having a foot-operated actuator element which is situated/situatable in the lower region of a door, for opening the door, the foot-operated actuator element having at least one foot tread element which, when actuated by a foot, at least partially pivots downwardly and inwardly, the foot tread element being at least also forcibly guided by means of a forcibly guided element and at least one forcibly guided moving element, and the foot tread element is rotatably connected to an articulated element and rotatably connected to the forcibly guided moving element in such a way that, when actuated by a foot, the foot tread element undergoes a movement downwardly and is also moved as a whole at least partially outwardly.

The invention likewise includes a door having a foot-operated door opener as set forth herein.

The invention further includes the use of a foot-operated door opener as set forth herein for installation in a door.

The foot-operated door opener according to the invention is equipped with a foot-operated actuator element which is situated/situatable in the lower region of a door, for opening the door, the foot-operated actuator element having at least one foot tread element, for example and in particular having a slightly convex, plate-like design, which, when actuated by a foot, i.e., by placing a foot on the foot tread element and applying force, at least partially pivots downwardly and inwardly, the foot tread element being at least also forcibly guided by means of a forcibly guided element, for example and in particular in the form of an arched material protrusion, and at least one forcibly guided moving element, for example and in particular designed as a flat part, for example and in particular having a triangular shape, which is hinged to a frame part of the foot-operated opener. The foot tread element is rotatably connected at an articulated joint to an articulated element, for example and in particular in the form of a rod-shaped element, and rotatably connected to the forcibly guided moving element, in particular in such a way that, when actuated by a foot, the foot tread element undergoes a movement downwardly and is also moved as a whole at least partially outwardly. It will be readily appreciated by a person having ordinary skill in the art that the movement at least partially pivots downwardly and inwardly of the foot tread element, and the movement downwardly and also moved as a whole at least partially outwardly of the foot tread element. As shown and described in connection with FIGS. 1-4, the foot tread element initially undergoes a movement downwardly and inwardly, and thereafter the foot tread element is also moved as a whole downwardly and at least partially outwardly, and indeed substantially entirely outwardly.

In this way, at least partial synchronization of the rotational movement and the translational travel of the foot tread element takes place, so that due to the outward translational travel, a larger foot support surface of the foot tread element is available to the operator, thus allowing easier handling.

In practice it has been found to be advantageous for the articulated element to have a rod-shaped design to allow a particularly large outward translational movement.

Furthermore, it is advantageous when the forcibly guided moving element is hinged to a frame part of the foot-operated door opener in order to minimize to the greatest extent possible friction forces which may occur along the progression of the forcibly guided element.

In this context, it is also advantageous when the forcibly guided moving element is designed as a flat part, for example and in particular having a triangular shape, so that, for example, over a wide progression along the forcibly guided element it is possible for the forcibly guided moving element to have contact with the forcibly guided element at more than one point in order to allow particularly secure forcible guiding.

Furthermore, it is advantageous when the forcibly guided moving element has at least one material formation, for example and in particular having a meandering shape, which corresponds to a frame part material formation, so that, in relation to the neutral position of the foot tread element or in the fully depressed state of the foot tread element, in each case material formations correspond to one another, thus allowing additional stabilization of the mechanism of the foot-operated door opener.

In addition, it is advantageous when the forcibly guided moving element has a receiving element, for example and in particular in the form of a groove, for accommodating the upper end of the foot tread element with respect to the neutral position of the foot tread element, to provide corresponding additional mechanical stabilization, optionally even before reaching the fully depressed end position of the lower foot tread element.

In addition, it is advantageous when the forcibly guided element has an arched or circular forcible guiding progression to achieve the most uniform movement possible along the progression of the forcibly guided element.

Furthermore, it is advantageous when the foot-operated door opener according to the invention is designed in such a way that the movability, i.e., the simultaneous rotation and translation, of the foot tread element is limited by means of at least one stop element, for example and in particular in the form of a rubber pad, it being particularly advantageous when the stop element is situated on the articulated element, so that when the stop element and the other parameters are appropriately dimensioned, the operator is provided with a secure, comfortable stop.

It is also advantageous when the foot tread element has a further forcibly guided moving element, for example and in particular beneath the foot tread element, in order to allow even better movability of the foot tread element during operation.

Furthermore, it is advantageous when a force element, for example and in particular in the form of a spring element, directly or indirectly engages with the foot tread element in such a way that the foot tread element is pulled into a neutral position without resistance on the foot of an operator, so that after a door engages in the lock/latch an immediate option is provided for the foot-operated door opener to be correspondingly re-actuated in order to open the door.

In this context, it is advantageous when the movement of the foot tread element caused by the restoring force of the force element is damped by means of a damper element, for example in the form of an oil brake cylinder, since this generally prevents the force element from pulling the foot tread element unbraked into its neutral position, which is typically associated with a high noise level since the foot tread element then runs against corresponding stops.

In addition, it is advantageous when the foot-operated door opener according to the invention is designed in such a way that upon actuation by the foot, a locking mechanism, for example and in particular in the form of a so-called "semi-trailer" mechanism, is activated which prevents the foot tread element from returning, in order to initially prevent uncontrolled travel into a neutral position of the foot tread element.

Furthermore, it is advantageous when the foot-operated door opener according to the invention is designed in such a way that when the door leaf and the door frame are situated opposite one another, the locking mechanism is unlocked, for example and in particular by means of magnetic force or mechanical force, to allow the door to engage in the lock very softly without the door falling against the door latch.

Relative terms such as up, down, left, and right, are for convenience only and are not intended to be limiting.

BRIEF DESCRIPTION OF THE DRAWINGS

The invention is described in a non-limiting manner with reference to the following figures, which illustrate the following.

DETAILED DESCRIPTION OF THE INVENTION

Figure 1:
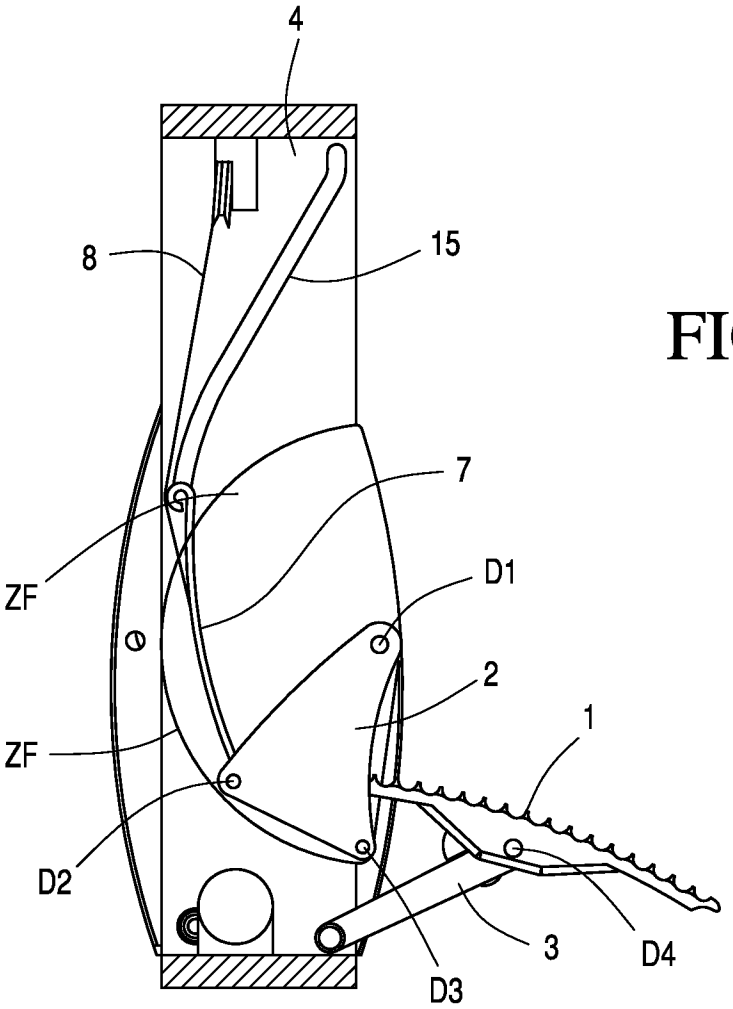
FIG. 1 shows a sketch-like cross-sectional view of a first embodiment of the foot-operated door opener according to the invention.

FIG. 1 shows a sketch-like cross-sectional view of a first embodiment in which a foot tread element 1 is hinged to a forcibly guided moving element 2 via an articulated joint D2. At the same time, the foot tread element 1 is hinged to the articulated element 3 via the articulated joint D4. Thus, upon actuation by the foot, the foot tread element 1 is moved both downwardly and outwardly, traveling in a rotational and also a translational manner. This movement takes place in a very controlled, secure manner, since the forcibly guided moving element 2 runs along the profile of the forcibly guided element ZF, and as a result of the hinging of the forcibly guided moving element 2 to a frame part 4 on the articulated joint D1, the forcibly guided moving element 2 is rotated downwardly and thus moves along the profile progression of the forcibly guided element ZF via the articulated joints D2 and D3. A second upper foot tread element 7 which is articulatedly connected to the foot tread element 1 via D2 moves downwardly in the slotted link progression of a slotted link element 15. In the process, a door lock opening force is generated (the door lock is not shown) due to pulling down of a wire 8 which is connected to the door lock (not shown) and which opens the door lock. The wire 8 is fastened to D2. Secure, comfortable operation of the foot-operated door opener is thus possible.

Figure 2:
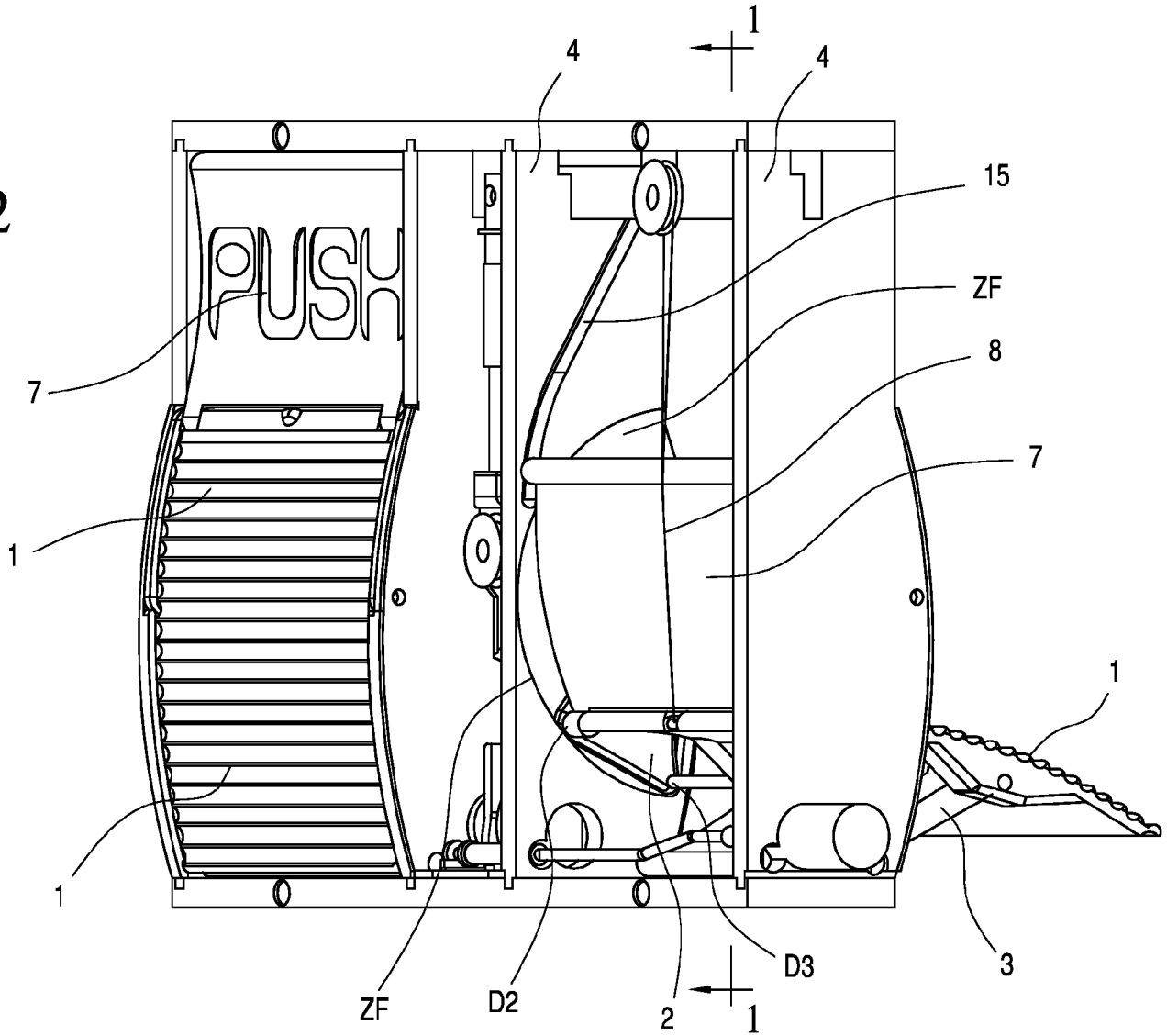
FIG. 2 shows a sketch-like perspective view of the embodiment shown in FIG. 1.

The above-described arrangement is shown in a perspective view in FIG. 2.

Figure 3:
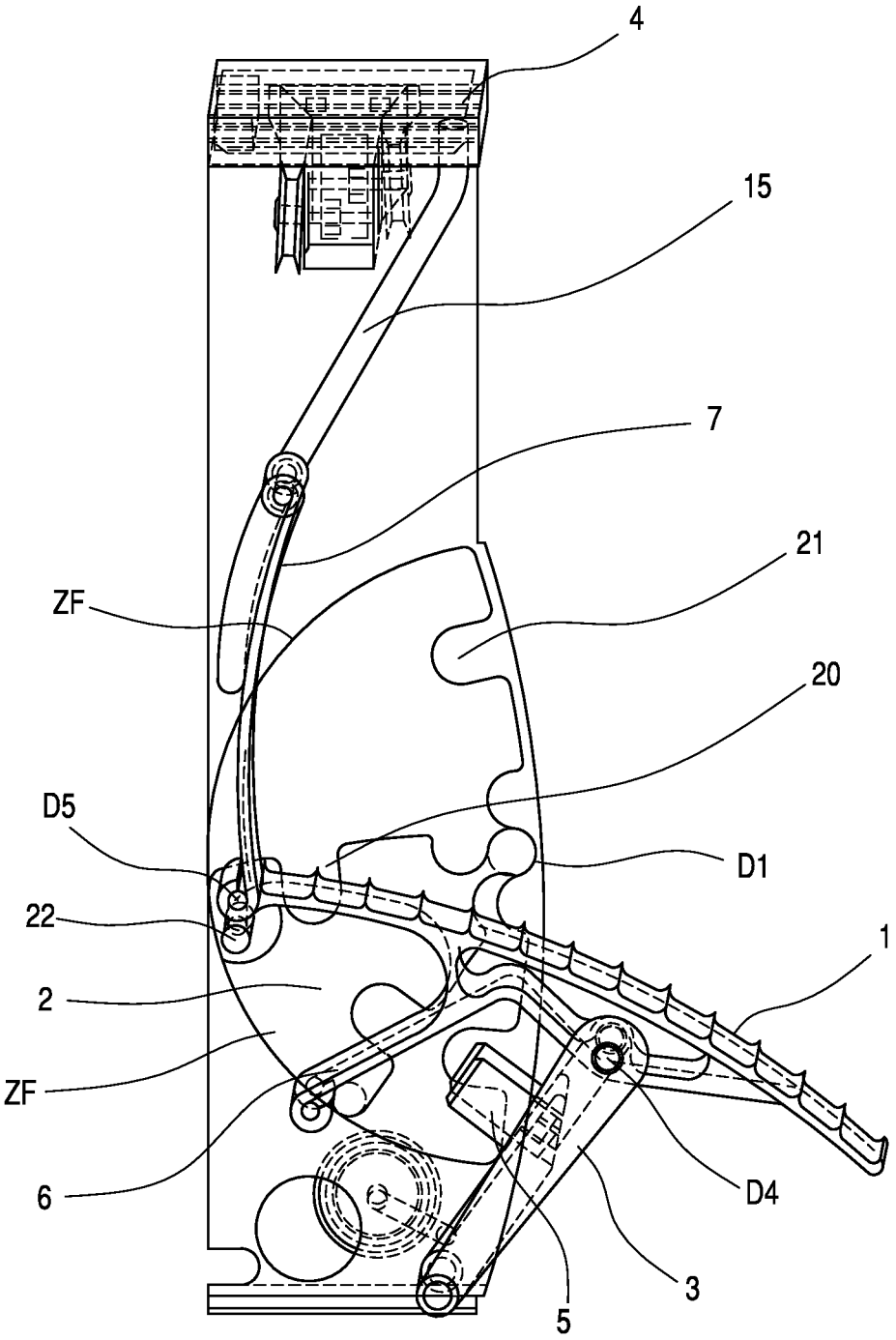
FIG. 3 shows a sketch-like perspective view of a second embodiment of the foot-operated door opener according to the invention.

In the design variant shown in FIG. 3, the foot tread element 1 has a second forcibly guided moving element 6 which also results in a controlled secure movement of the foot tread element 1 and of the forcibly guided moving element 2 along the profile of the forcibly guided element ZF. At the same time, when the foot tread element 1 is depressed, the second forcibly guided moving element 6 runs against the rubber-like stop element 5, thus striking it and limiting the movability, i.e., the rotating movement as well as the translational movement, of the foot tread element 1.

The two foot tread elements (upper foot tread element 7 and lower foot tread element 1) are connected to one another in an articulated, manner via an articulated joint D5. A frame material formation or material protrusion 21 of the frame part 4 corresponds to a material formation or material indentation 20 in the forcibly guided moving element 2, so that additional mechanical stabilization of the mechanism of the foot-operated door opener according to the invention is achieved in the neutral position of the foot tread element 1 and also in the fully depressed position of the foot tread element 1. In this case, the articulated joint D1 is designed as a "bone joint," in a manner of speaking, which primarily ensures that dislocation is prevented, and D1 is relieved of significant stress due to the large-surface contact of the forcibly guided moving element 2 on the forcibly guided element ZF. The foot tread element 1 is articulatedly connected to the articulated element 3 via D4. As shown in FIG. 3, for example, the material protrusion 21 may be termed a first mating portion or protrusion, the material formation 20 may be termed a second mating portion or indentation, and first mating portion corresponds to and mates with the second mating portion as shown.

Figure 4:
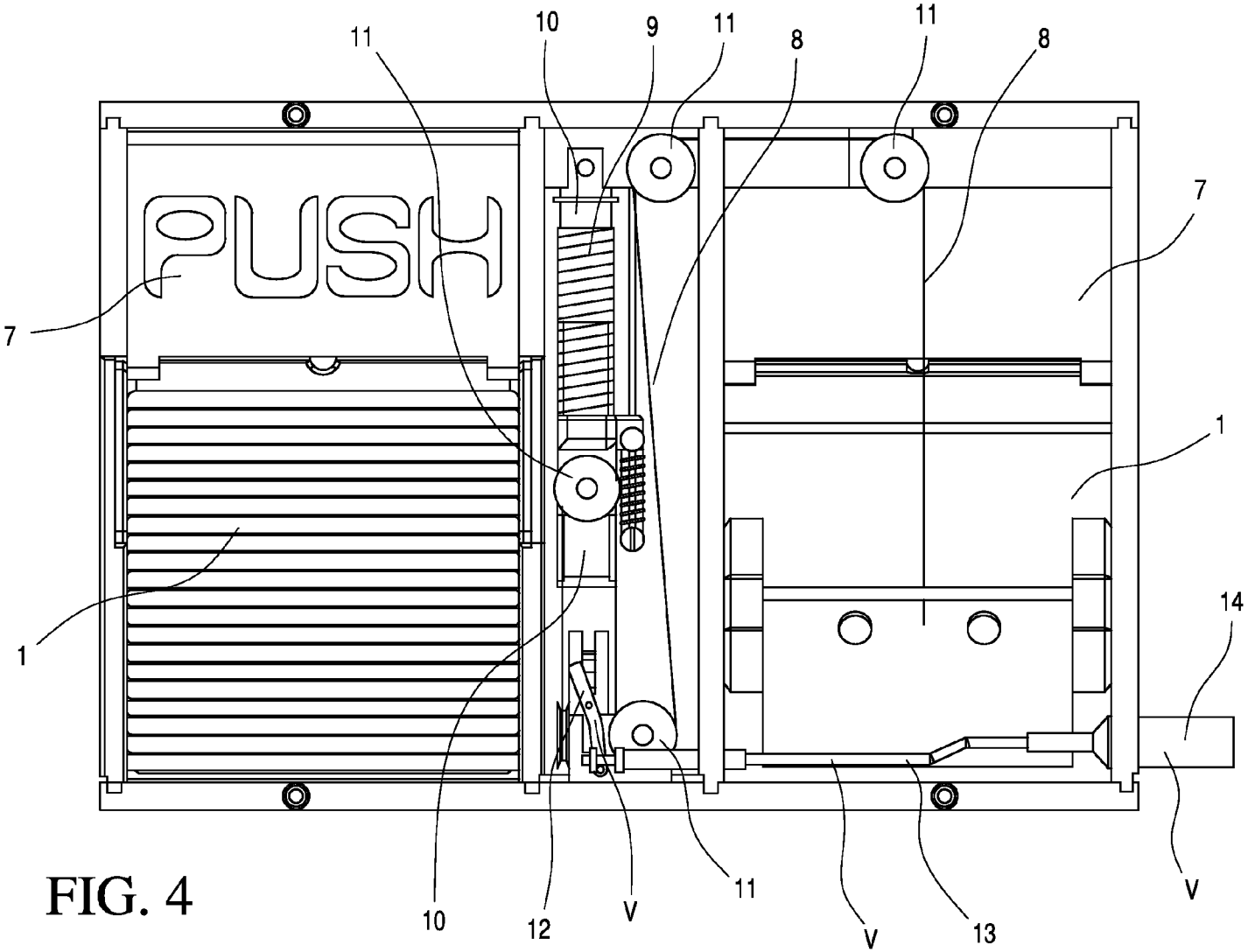
FIG. 4 shows a sketch-like view of the embodiment shown in FIG. 1 as taken in the direction of arrow 1-1 shown in FIG. 2, together with other details.

FIG. 4 shows the first embodiment in FIGS. 1 and 2 in a top view. It is apparent in particular that the wire 8 is connected via multiple deflection rollers 11 to a force element 9 in the form of a spring element which applies continuous upward force on the foot tread element 1. The action of force of the spring element 9 is damped by an oil pressure damper as a damper element 10, so that the movement of the two foot tread elements 1 and 7 into a neutral position occurs in a slowed, damped manner; in the process, the foot tread element 1 is pulled upwardly and inwardly. Beginning at a certain level of actuation by the foot (i.e., stepping down on the foot tread element 1), the return of the foot tread elements 1 and 7 is prevented by means of a locking mechanism V in the form of a "semitrailer" mechanism.

When the door closes, so to speak, the door leaf and the door frame are situated opposite one another, so that the magnet element 14 (which may be an actual magnet or a ferromagnetizable material) is thus drawn toward an oppositely situated magnet (not shown), so that the lock V is unlocked via the rod assembly 13 and the lever 12. The lock latch of the door is thus closed, and at the same time, the two foot tread elements 1 and 7 slowly travel into their neutral position in a damped manner.

All of the figures involve a double design variant of the foot-operated door opener according to the invention, which when installed in a door thus allows the door to be opened from both sides.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention.

The invention claimed is:

1. Foot-operated door opener, comprising:

a) a foot-operated actuator element which is locatable in a lower region of a door, for opening the door;

b) the foot-operated actuator element having a foot tread element which, when actuated by a foot, at least partially pivots downwardly and inwardly, the foot tread element being at least also forcibly guided by means of a forcibly guided element and at least one forcibly guided moving element; and c) the foot tread element being rotatably connected at an articulated joint to an articulated element and rotatably connected to the forcibly guided moving element in such a way that, when actuated by a foot, the foot tread element initially undergoes a movement downwardly and inwardly, and thereafter the foot tread element is also moved as a whole downwardly and substantially entirely outwardly.

2. Foot-operated door opener according to claim 1, wherein:

a) the articulated element has a rod-shaped configuration.

3. Foot-operated door opener according to claim 1, wherein:

a) the forcibly guided moving element is hinged to a frame part of the foot-operated door opener.

4. Foot-operated door opener according to claim 1, wherein:

a) the forcibly guided movement element is configured as a flat part.

5. Foot-operated door opener according to claim 4, wherein:

a) the forcibly guided moving element has a first mating portion and the frame part has a second mating portion; and b) the first mating portion on the forcibly guided moving element corresponds to and mates with the second mating portion.

6. Foot-operated door opener according to claim 5, wherein:

a) the first mating portion includes a protrusion and the second mating portion includes an indentation.

7. Foot-operated door opener according to claim 4, wherein:

a) the forcibly guided moving element has a receiving element for accommodating an upper end of the foot tread element with respect to a neutral position of the foot tread element.

8. Foot-operated door opener according to claim 1, wherein:

a) the forcibly guided element has an arched or circular forcible guiding progression.

9. Foot-operated door opener according to claim 1, wherein:

a) the foot-operated door opener is configured in such a way that the movability of the foot tread element is limited by means of at least one stop element.

10. Foot-operated door opener according to claim 9, wherein:

a) the at least one stop element is situated on the articulated element.

11. Foot-operated door opener according to claim 1, wherein:

a) the foot tread element has a further forcibly guided moving element.

12. Foot-operated door opener according to claim 1, wherein:

a) a force element directly or indirectly engages with the foot tread element in such a way that the foot tread element is pulled into a neutral position without resistance on the foot of an operator.

13. Foot-operated door opener according to claim 12, wherein:

a) movement of the foot tread element caused by a restoring force of the force element is damped by means of a damper element.

14. Use of a foot-operated door opener according to claim 1 for installation in a door.

15. Foot-operated door opener, comprising:

a) a foot-operated actuator element which is locatable in a lower region of a door, for opening the door;

b) the foot-operated actuator element having a foot tread element which, when actuated by a foot, at least partially pivots downwardly and inwardly, the foot tread element being at least also forcibly guided by means of a forcibly guided element and at least one forcibly guided moving element;

c) the foot tread element being rotatably connected at an articulated joint to an articulated element and rotatably connected to the forcibly guided moving element in such a way that, when actuated by a foot, the foot tread element initially undergoes a movement downwardly and inwardly, and thereafter the foot tread element is also moved as a whole downwardly and substantially entirely outwardly; and d) the foot-operated door opener is configured in such a way that upon actuation by the foot, a locking mechanism is activated which prevents the foot tread element from returning.

16. Foot-operated door opener according to claim 15, wherein:

a) the foot-operated door opener is configured in such a way that the locking mechanism is unlocked when a door leaf and a door frame of the door are situated opposite one another.

17. Foot-operated door opener according to claim 16, wherein:

a) the unlocking occurs by means of magnetic force or mechanical force.

18. A door, the door comprising:

a) a) foot-operated door opener, the foot-operated door opener including:

i) a foot-operated actuator element which is locatable in a lower region of a door, for opening the door;

ii) the foot-operated actuator element having a foot tread element which, when actuated by a foot, at least partially pivots downwardly and inwardly, the foot tread element being at least also forcibly guided by means of a forcibly guided element and at least one forcibly guided moving element; and iii) the foot tread element being rotatably connected at an articulated joint to an articulated element and rotatably connected to the forcibly guided moving element in such a way that, when actuated by a foot, the foot tread element initially undergoes a movement downwardly and inwardly, and thereafter the foot tread element is also moved as a whole downwardly and substantially entirely outwardly.

* * * * *